United States Patent [19]

Walker

[11] Patent Number: 4,520,988

[45] Date of Patent: Jun. 4, 1985

[54] CONCRETE CORE-WALL FORM AND STRIPPING ASSEMBLY THEREFOR

[75] Inventor: Eugene P. Walker, N. Bergen, N.J.

[73] Assignee: Harsco Corporation, Wormleysburg, Pa.

[21] Appl. No.: 602,891

[22] Filed: Apr. 23, 1984

[51] Int. Cl.[3] ..... E04G 15/06; B28B 7/30

[52] U.S. Cl. ..... 249/13; 249/27; 249/48; 249/178; 249/185; 249/194

[58] Field of Search ..... 249/179, 180, 181, 178, 249/185, 170, 171, 13, 11, 27, 48, 49, 182, 194

[56] References Cited

U.S. PATENT DOCUMENTS

| | | | |
|---|---|---|---|
| 950,827 | 3/1910 | Smith . | |
| 1,901,392 | 3/1933 | Frederick | 249/48 X |
| 2,557,631 | 6/1951 | Callan | 249/178 |
| 2,707,814 | 5/1955 | Francis et al. | 249/181 |
| 2,818,627 | 1/1958 | Blasius et al. | 249/181 |
| 2,854,725 | 10/1958 | Bast et al. | 249/181 |
| 2,929,125 | 3/1960 | McGinnis et al. | 249/181 |
| 3,676,536 | 7/1972 | Shelley | 249/178 X |
| 3,754,717 | 3/1933 | Daidla . | |
| 3,811,646 | 5/1974 | Beasley | 249/180 X |
| 3,894,711 | 7/1975 | Van der Lely et al. | 249/180 X |
| 3,926,403 | 12/1975 | Markewitz et al. . | |
| 3,990,673 | 11/1976 | Jones et al. . | |
| 4,055,321 | 10/1977 | Schimmel | 249/185 X |
| 4,418,884 | 12/1983 | Schimmel | 249/11 |
| 4,463,925 | 8/1984 | Schimmel | 249/11 |
| 4,465,257 | 8/1984 | Schimmel | 249/11 |

*Primary Examiner*—J. Howard Flint, Jr.

*Attorney, Agent, or Firm*—Kerkam, Stowell, Kondracki & Clarke

[57] ABSTRACT

What is proposed is an inwardly articulated form assembly for forming concrete core-wall structures having a rectangular shape in which a primary form structure having fixed seamless corners is presented to the wet concrete; after the concrete has set, a secondary support structure which effects a compound movement when activated by a lever assembly connected thereto causes the primary form to articulate inwardly in a progressively centripetal movement towards the interior of the core-shaft about vertically extending double hinge structures connecting parts of the secondary support structure near respective corners thereof.

15 Claims, 9 Drawing Figures

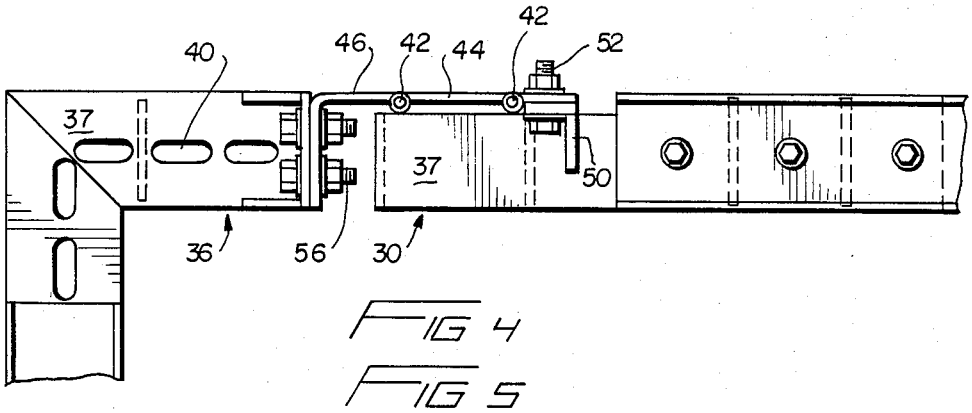
FIG 4
FIG 5
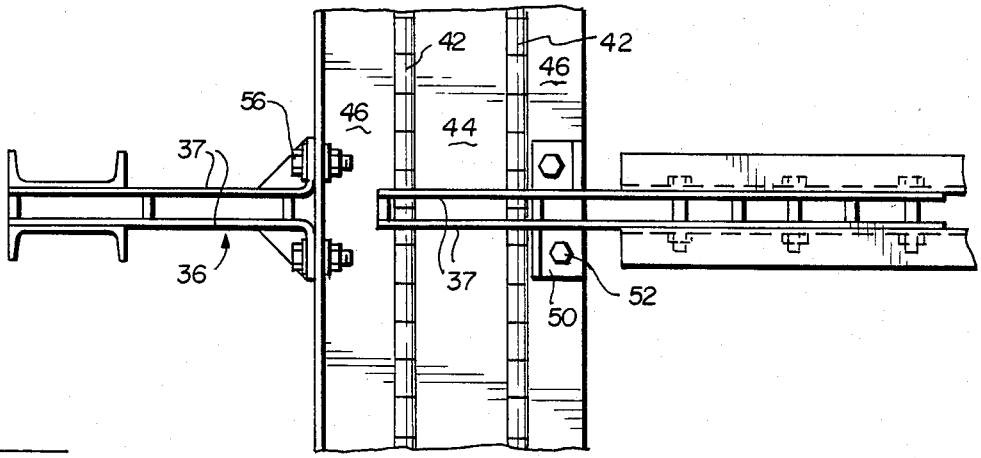
FIG 6
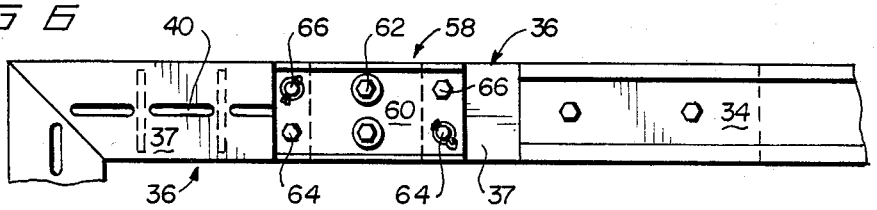
FIG 7
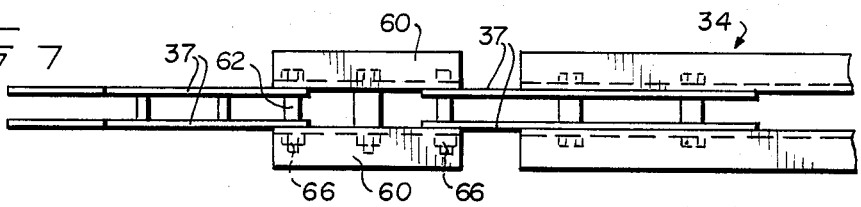
FIG 8
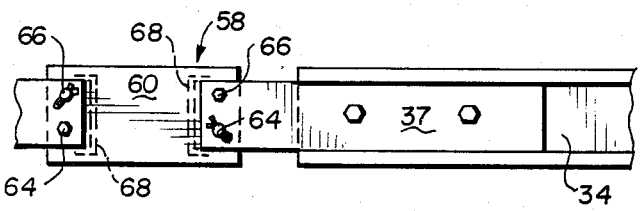
FIG 9
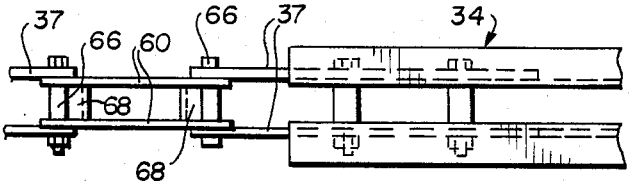

CONCRETE CORE-WALL FORM AND STRIPPING ASSEMBLY THEREFOR

BACKGROUND OF THE INVENTION

This invention relates generally to forms for concrete structures, and particularly those kinds of structures in which an interior face or faces are formed, commonly known as core-walls, for the construction of elevator shafts, stairwells, tunnels, culverts and similar structures in which an interior space is desired.

These and other concrete structures are normally formed by the use of prefabricated forming systems that are assembled into gang forms by means of appropriate connecting hardware such as gang rods and bolts etc. The assembled gang form is then crane handled into a final concrete pouring position. In the case of forming core-walls, an outside form is also assembled to thereby create a median space between the inner core form and the outer form, which space then receives the wet concrete. Removal or stripping of the core-wall form from the concrete, once the latter has set, has been done in the past by using hinge assemblies located at each corner of the form, as well as at locations generally midway between the corners of the form, so that the entire form is made to collapse inwardly and thereby allow its subsequent removal from the concrete core or shaft.

More recently such articulated collapsible forms have been designed with fixed sides and end walls having only a hinge assembly at each corner of the form, such as shown in U.S. Pat. No. 4,055,321. In this way, the rigidity of the form structure is somewhat enhanced and therefore not entirely sacrificed at the expense of articulated collapsibility, it being understood that a foremost criterion is that the form itself should preferably present a smooth and rigid surface to the wet concrete.

Lessening the number of joints or hinges in the form structure is, of course, a desirable end in itself, and the present state of the art does reflect the direction taken towards this end. However, there still remains much room for improvement if an ideal form structure for forming smooth concrete core wall surfaces is to be realized in which such a form, (1) presents a smooth surface to the wet concrete, (2) uses a minimum number of joints and hinges, (3) minimizes the time required to activate the hinges and hinge related structures and joints to thus strip the form from the concrete, and (4) offers a rigid structure to the cement in the setting stage, especially at the corners which must be maintained at 90° for acceptable rectangular or square configurations of the finished core shaft.

SUMMARY OF THE INVENTION

In order to advance the state of the art in the direction as outlined above, the present invention has for its general purpose to provide a form structure and stripping assembly therefor for use with an outer form structure in the formation of concrete core wall structures in which the core-wall form structure is designed as an integrated three-part structure, comprising a primary or outer form element, that is, that part which makes contact with the cement, a secondary or inner form element which is the support for the primary form, and a tertiary element, namely, the connecting hardware such as hinges' turnbuckles, bolts, wedges, etc.

In accordance with the principles of the invention, a core-wall form structure comprising the three elements above described provides a secure rigid secondary form structure which maintains the entire structure in a rigid rectangular or square configuration having fixed joint free 90° corners. By means of a unique arrangement of hinge construction located in the secondary support form adjacent but not in the corner areas, the entire structure is caused to collapse away from the concrete surface or wall in a progressive, generally circular motion that is in effect directed centripetally towards the interior of the core shaft being formed, so that the primary form is in effect eased off progressively, that is, peeled off from the concrete wall, thus avoiding a ruptured break from the wall which could cause tearing, chipping or gouging in the concrete surface. Further, in accordance with the inventive principles, the means for activating the hinge structures has been streamlined so that the stripping time of the core-wall form has been considerably lessened from what was required by the prior art devices.

The apparatus according to the invention provides a primary form structure comprising wood or steel panels forming a rectangle having fixed seamless corners and thereby offers an improved continuous wall surface having a minimum of seams to the wet concrete. Adjacent each corner on one of the wall faces of the primary form forming each corner is a seam parallel to and extending the length of each corner. By means of the seam in each wall face of the primary form, the rectangular form is effectively divided into four L-shaped structures in which the crook of each L forms one of the seamless corners of the form.

Connected to the primary form by suitable tie assemblies is the secondary supporting structure, namely the waler members and waler extension members the latter of which extend the waler structure to fit the respective corners of the form, thereby reinforcing the rigidity of the 90° corners as well as ensuring the rigidity of the wall faces of the primary form.

The tertiary element above-mentioned comprises the connecting hardware for connecting the double-hinge structure to the respective and opposing faces of the waler members adjacent the seam in each wall face of the primary form, as well as a combination turnbuckle and lever assembly for activating the double hinge structures, that is, made to pivot so that the primary form articulates inwardly toward the center of the core shaft in the manner above described. To accommodate this kind of movement, the waler members of the secondary support structure are allowed to move in a compound motion with respect to each other in the vicinity of each corner of the form. In this way a novel means is provided for first loosening the primary element, that is the primary form from the concrete wall, and then by means of the lever action a single mechanical movement is effected in one simple movement for pulling or stripping the form completely away from the concrete surface or wall. By simply reversing the steps above-described, the form structure can be set in place before the concrete is poured by first operating the lever assemblies in a single movement and then "fine tuning" the form if required by means of the turnbuckle devices for adjusting the corners to an exact 90° angle.

The invention will be better understood as well as further objects and advantages thereof become more apparent from the ensuing detailed description taken in conjunction with the drawings.

BRIEF DESCRIPTION OF THE DRAWINGS

FIG. 4 is a plan view of a corner section of the apparatus shown in FIG. 3;

FIG. 5 is an elevation view of the corner construction shown in FIG. 4;

FIG. 6 is a plan view of a further embodiment of the hinge structure shown in FIGS. 4 and 5;

FIG. 7 is an elevation view of the hinge structure shown in FIG. 6;

FIG. 8 is a plan view of a modification of the embodiment shown in FIGS. 6 and 7; and FIG. 9 is an elevation view of FIG. 8.

DETAILED DESCRIPTION

Figure 1:
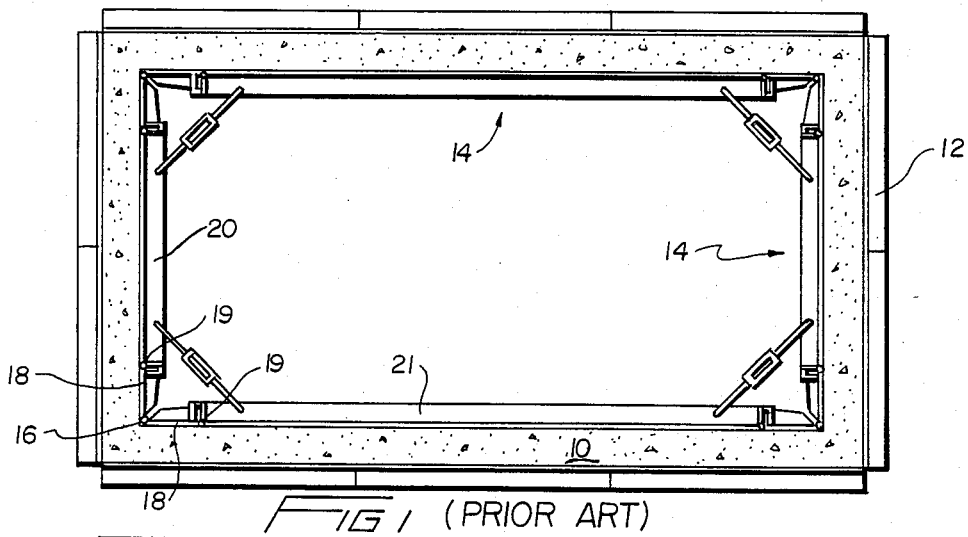
FIG 1 (PRIOR ART)
FIG. 1 is a plan view of a prior art device for forming a concrete core wall structure.
Figure 2:
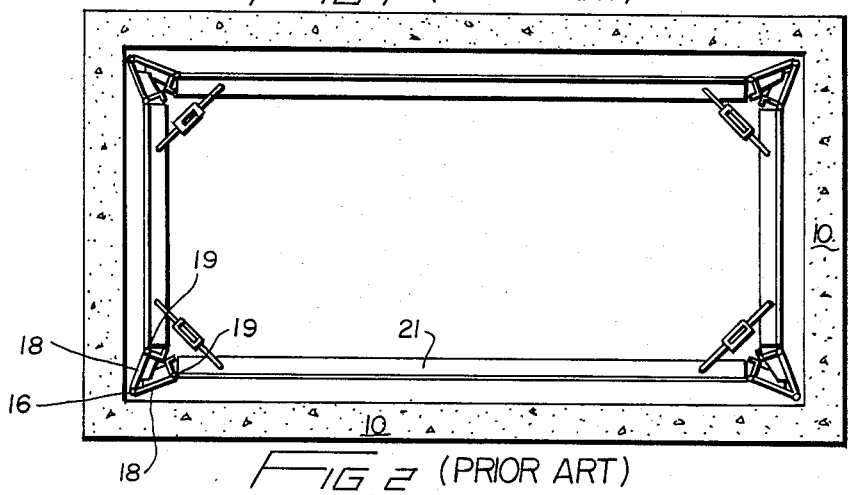
FIG 2 (PRIOR ART)
FIG. 2 is a plan view of a device shown in FIG. 1 in which the form structure is shown in a loosened position.

Referring now to FIGS. 1 and 2, the prior art device is shown in which an outer form structure 12 and inner form structure 14 which forms the core-wall is seen to be positioned in place for the cement pouring operation, the cement 10 having been received in the median space provided by the inner and outer forms. At each corner of the inner form 14 can be seen a tri-part hinge construction consisting of a corner hinge 16 extending the depth of the form which has two leaf members 18, the free ends of which form further hinges 19 that are connected by a suitable leaf members with a respective end rail 20 and a side rail 21. A turnbuckle 22 is shown connected between adjacent end rails and side rails by which means the hinges can be activated to an operative position as shown in FIG. 2. In this position the corner hinge 16 of the tri-part hinge assembly is brought to an acute angle which in turn causes the hinges 18 to form an obtuse angle, and thus break off or away from the concrete wall or surface. Each corner of the inner form 14 is adjusted in like manner to cause that particular part of the form to break away from the corner of the core-wall so that the entire form retains its rectangular configuration. Each of the corners, because of the tri-part hinge construction, is infinitely adjustable, and therefore must be adjusted by means of the turnbuckle to form a precise rectangle or square form, which is not only a time consuming operation but in many cases may not result in precise 90° corners, since the human factor is always controlling in adjusting the turn buckles. Additionally, as mentioned above, the corners are not rigid even in the finally adjusted position because there always will be some play in the corner hinge construction, especially in a multiple hinge construction as shown.

Figure 3:
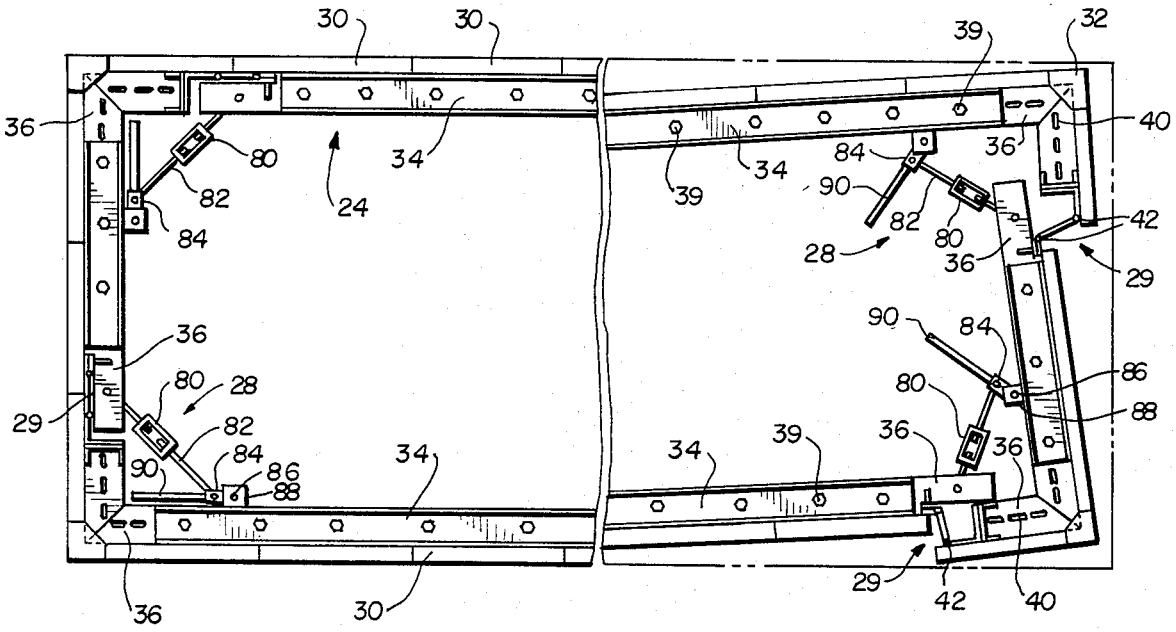
FIG. 3 is a plan view of a core wall form structure according to the principles of the invention.

In order to overcome these defects, the apparatus according to the invention, and as shown in FIG. 3, provides a core-wall form structure that comprises rigid corners and a minimum of hinge seams in which there are three basic elements:

1. a primary form 24;
2. a supporter backup section assembly 26; and
3. a stripping assembly and connecting hardware element designated generally at 28 and 29.

The primary form structure may be composed of wood or steel panels 30 which are gang formed into a modular assembly to form wall surfaces, that is, end walls and side walls and, in this particular case, the four corners 32 that in turn define the corners of the core-shaft structure formed by the cement 10. Panels 30 together with filler panels 31 (which may be added in those cases where a desired dimension requires such an addition) generally have no designated top or bottom, and can, therefore, be placed edge to edge, horizontally or vertically, in a mixed or uniform pattern to achieve nearly any configuration of any size. Such panels are connected by means of suitable hardware such as wedge bolts and tie bolts in a well known manner such as described in applicant's brochure publication entitled "MOD-U-FORM: Modular Panel Concrete Forming System" (1979).

The secondary element 26 of the assembly shown in FIG. 3 is composed of double channel waler members 34 arranged in a plane normal to the plane or dimension of the panels of the primary form structure 24. Only one tier of the waler members is shown, it being understood that several tiers make up a support package for the entire primary form, the exact number depending on the height or depth of the form assembly desired. The distance between each tier of waler members can vary according to the weight and size of a form to be constructed, but in most cases, such distances are commonly in a range between 18 and 36 inches. Each of the waler members 34 comprise a parallel pair of channel members between which at one end thereof is slidably mounted a waler extension member 36 which extends into the corner 32 of the primary form and forms a right angle therewith, as shown. The extension members 36 each comprise a pair of spaced apart parallel plate members 37 to be described in more detail below, but together as a unit slide between the channel members of the waler member 34. The extension members are provided with elongated slots 40 to facilitate their being adjusted and bolted to their associated waler members by suitable bolts 39. The other end of each waler member 34 is similarly connected to an extension member which terminates just past the double hinge structure 29 but is free to slide past the extension member connected with the adjacent waler member. The waler members themselves are secured to the primary form 24 by means of suitable gang rods not shown which fit between the channel members and connect a plate washer on the whaler side with suitable coil ties, not shown within the panels 30, that is on the panel side of the connection.

It will be seen that the primary form 24 is a continuous rigid rectangular structure having fixed rigid corners. Each of the hinge structures 29 divides the entire form into four separate L-shaped members in which the crook of each L forms a corner 32. The break between the respective extension members 36 adjacent each corner thus connects the double hinged structure 29 which vertically extends the depth of the entire form. The hinges are shown in a closed position in the left hand side of FIG. 3 and in the right hand side in an open or activated position.

Referring now to FIGS. 4 and 5, the hinge structure 29 comprises a double hinge joint 42, a connecting leaf 44 therebetween, and two end leaf members 46. The leaf member remote from the corner 32 is a flat plate which is secured to the waler extension members 36 by means of brackets 50 which are welded to the top and bottom plates 37, as shown. Bolts 52 secure the brackets 50 to the extension members 36.

The hinge leaf member 46 nearest the corner 32 is a right angle plate member and is secured by bolts 56 to the right angle ends of the other extension member 36 associated with the adjacent waler member.

In FIGS. 6 and 7 is shown a further embodiment of the hinge structure shown in FIG. 5. In this case the double hinge structure is replaced by a double hinge-acting parallel plate device 58 which comprises two parallel plates 60 separated by support bolts and spacers 62. Each end of the plate structure is secured to the respective plates 37 of the extension members 36 by means of a pair of bolts, one of which acts as a pivot bolt 64 and the other of which acts as a locking bolt 66. Unlike the previous embodiment, this embodiment allows the hinge structure to be locked in place thus adding a locking feature to the connecting hardware or tertiary element of the overall structure.

In FIGS. 8 and 9 is shown a further modification of the embodiment shown in FIGS. 6 and 7, namely, that the parallel plates are shown to be inserted between the plates 37 of the extension members 36, and for this purpose the plates 37 are positioned on the outside of their respective waler rather than on the inside, as previously shown. Also, the parallel plates 60 are spaced apart by means of spacer members 68 which fit generally in the area defined by the bolts 64 and 66. Similar to the previous described embodiment, the locking pins 66 provide a locking feature in addition to the lever assembly 28 of the tertiary element.

Cooperating with each corner of the core-wall form assembly 24, according to the invention, is a novel stripping assembly for activating the hinge structures 29 as above described. As shown in FIG. 3, the assembly 28 comprises a combination cam lever and a turnbuckle structure 80, the latter of which is secured between the channel plates of the appropriate waler member 34 by means of one of the bolts 39 extending therethrough. The other end of the assembly 28 comprises a bar member 82 having one end thereof welded to one end of the turn buckle device 80 and its other free end pivotally mounted by means of a bolt between a parallel pair of plate members 84 which extend from a welded connection to a vertically extending rod 86 which is journaled through a plate member 88 secured between the channels of the appropriate waler member 34 by means of a suitable bolt. Naturally, for each waler tier, of which only one is shown, or at least every other waler tier similar journal plates 88 and combination cam lever and turnbuckle assembly 80 are provided and secured in the manner already described in order to provide an axially aligned and multiple support for the vertical rod 86. In order to rotate the rod 86, a handle member 90 extending at right angles therefrom is also provided. More than one handle 90 may be provided in order to increase the power required to rotate the rod 86.

The core-wall form stripping assembly operates in the following manner. Setting up the assembly as shown in the left hand side of FIG. 3, the outer form is positioned in place while the inner form structure, that is, the core-wall form structure according to the invention, is positioned inside the outer form as shown. The connecting hardware which forms the tertiary element of the form is operative so as to define a rectangular or square form structure. Thus, the double hinge structures 29 are in place, as shown in the left of FIG. 3, thus ensuring a strong straight line connection between the corners 32 so that the primary form 24 is also rigidly straight and rectangular. A lip member, not shown, may be provided on an inside wall of the primary form 24 adjacent each seam, so that a tight fit is insured along the seam when the wall faces are in the closed position. Each of the lever assemblies are positioned as shown to the left wherein the plate members 88 are seen to be generally parallel to the waler members 34. In this closed position of the lever assemblies 28, the turnbuckle devices 80 may be adjusted to square off the corners 32 if such are seen to be greater or less than 90°. Once the core-wall form is in place, the cement 10 is then poured in the median space to form the core-wall structure desired. After the cement has set, the outer form is removed in a well known manner, and the handles 90 are then manually rotated so that the plate members 88 swing outwardly from the waler members 34 to a generally right angled position with respect thereto. This action causes the hinge structures 29 to activate, that is, first one of the hinges 42 which is remote from the corner 32 pivots so as to form an arcuate path or swing between the connecting leaf members 46 and 44, while at the same time the waler extension members 36 undergo a compound motion as best shown in the right hand side of FIG. 3. This action causes that part of the primary form 24 to the left of the hinge to strip or lift gradually away from the concrete in a progressive peeling-like action, while at the same time lifting that part of the primary form away from the concrete at a point defined by the right hinge 42. In this way, the particular corner 32 of the primary form associated with the hinge being activated will undergo a rotational movement inwardly towards the core shaft with the direction thereof pivoting generally about the hinge 29, such as shown in the lower right hand corner of FIG. 3. Normally, this operation is performed in a diagonal manner, that is, the corners 32 that are diagonally related are removed or stripped in succession; however, the corners 32 can be removed or stripped from the concrete in a clockwise or a counter-clockwise manner because of the generally rotational and centripetal action of the entire form articulating inwardly. When all the corners are thus removed away from the cement 10, the entire core-wall form is then crane-lifted out of the shaft.

The foregoing relates to a preferred embodiment of the invention, it being understood that other embodiments and variants thereof are possible within the spirit and scope of the invention, the latter being defined by the appended claims.

What is claimed is:

1. An inwardly articulated form assembly for forming a rectangular shaped concrete core-wall structure comprising:

a primary form having exterior wall faces and corners defining a rectangle corresponding to said concrete core-wall structure to be formed, each of said wall faces having a vertically extending seam such that there is at least one seam adjacent each of said corners, and a secondary support means engaging interior portions and corners of said primary form, said support means having a double hinge means corresponding to each seam and operable for effecting a compound movement of said support means to cause each of said wall faces of said primary form to articulate inwardly away from said core-wall structure about said double hinge means, each double hinge means having two pivot axes disposed along and inwardly from a corresponding one of said wall faces, each double hinge means disposed closer to a corresponding corner than it is the other corners, said secondary support means forming rigid angles at the corners.

2. An assembly according to claim 1, wherein said secondary support means comprises a waler member affixed to each interior wall of said primary form in a plane normal thereto and having a first extension member extending from one end of said waler member to form a right angle with the interior of a respective corner of said corners of said primary form.

3. An assembly according to claim 2, wherein the other end of said waler member remote from said first extension member associated therewith comprises a second extension member, and said double hinge means connecting said first and second extension members.

4. An assembly according to claim 3, wherein said double hinge means comprises a pair of leaf members having removable bolt means for connecting said double hinge means to said first and second extension members.

5. An assembly according to claim 2, further comprising a lever means having a rotatable bar journaled to said waler member, said bar having an extension means for pivotally supporting a rod member, and said rod member being connected via a turnbuckle means to an adjacent waler member.

6. An inwardly articulated form assembly for forming a rectangular shaped concrete core-wall structure comprising:

a primary form having exterior wall faces and corners defining a rectangle corresponding to said concrete core-wall structure to be formed, each of said wall faces having a vertically extending seam such that there is at least one seam adjacent each of said corners, a secondary support means engaging interior portions and corners of said primary form, said support means having a double hinge structure corresponding to each seam and operable for effecting a compound movement of said support means to cause each of said wall faces of said primary form to articulate inwardly away from said core-wall structure about said double hinge means, and a lever means connected to said secondary support means for initiating said compound movement, and wherein each double hinge structure has two pivot axes disposed along and inwardly from a corresponding one of said wall faces, each double hinge structure disposed closer to a corresponding corner than it is to the other corners, said secondary support means forming rigid angles at the corners.

7. An assembly according to claim 6, wherein said secondary support means comprises a waler member having two parallel spaced apart channel members, said waler member being affixed to each interior wall of said primary form in a plane normal thereto and having a first extension member comprising a pair of spaced apart parallel plates extending from the space between said channel members of said waler member from one end thereof to form a right angle with the interior of a respective corner of said corners of said primary form.

8. An assembly according to claim 7, wherein the other end of said waler member remote from said first extension member associated therewith comprises a second extension member, and said double hinge means connecting said first and second extension members.

9. An assembly according to claim 8, wherein said double hinge means comprises a pair of leaf members having removable bolt means for connecting said double hinge means to said first and second extension members.

10. An assembly according to claim 7, wherein said lever means comprises a rotatable bar journaled to said waler member, said bar having an extension means for pivotally supporting a rod member, and said rod member being connected via a turnbuckle means to an adjacent waler member.

11. An inwardly articulated form assembly for forming a rectangular shaped concrete core-wall structure comprising:

a primary form having exterior wall faces and corners defining a rectangle corresponding to said concrete core-wall structure to be formed, each of said wall faces having a vertically extending seam such that there is at least one seam adjacent each of said corners, and a secondary support means engaging interior portions and corners of said primary form, said support means having a waler member comprising two parallel spaced apart structural members, said waler member being fixed to each interior wall of said primary form in a plane normal thereto and having a first extension member extending from the space between said structural members of said waler member from one end thereof to form a right angle with the interior of a respective corner of said primary form, and said support means having a double hinge means corresponding to each seam and operable for effecting a compound movement thereof to cause each of said wall faces of said primary form to articulate inwardly away from said core-wall structure about said double hinge means, each double hinge means having two pivot axes disposed along and inwardly from a corresponding one of said wall faces, each double hinge means disposed closer to a corresponding corner than it is to the other corners, said secondary support means forming rigid angles at the corners.

12. An assembly according to claim 11, wherein the other end of said waler member remote from said first extension member associated therewith comprises a second extension member, and said double hinge means connecting said first and second extension members.

13. An assembly according to claim 12, wherein said double hinge means comprises a pair of leaf members having removable bolt means for connecting said double hinge means to said first and second extension members.

14. An assembly according to claim 11, further comprising a lever means having a rotatable bar journaled to said waler member, said bar having an extension means for pivotally supporting a rod member, and said rod member being connected via a turnbuckle means to an adjacent waler member.

15. The assembly according to claim 2, wherein each waler member had two parallel spaced apart structural members and each extension member comprises a pair of spaced apart parallel plates extending from the space between said structural members.

* * * * *